US007012228B1

(12) United States Patent
Eke et al.

(10) Patent No.: US 7,012,228 B1
(45) Date of Patent: Mar. 14, 2006

(54) MICROWAVE OVEN WITH PHASE MODULATOR AND FAN ON COMMON DRIVESHAFT

(75) Inventors: Kenneth Ian Eke, Franklin, TN (US); Graham Christopher Eke, Franklin, TN (US)

(73) Assignee: Microwave Ovens Limited, Surrey (GB)

( * ) Notice: Subject to any disclaimer, the term of this patent is extended or adjusted under 35 U.S.C. 154(b) by 0 days.

(21) Appl. No.: 10/937,712

(22) Filed: Sep. 9, 2004

(51) Int. Cl.
*H05B 6/74* (2006.01)
*H05B 6/80* (2006.01)

(52) U.S. Cl. ..... 219/681; 219/751; 219/746; 219/757

(58) Field of Classification Search ..... 219/745–751, 219/681, 757, 756
See application file for complete search history.

(56) References Cited

U.S. PATENT DOCUMENTS

| | | | | |
|---|---|---|---|---|
| 4,297,558 | A | 10/1981 | Inayama et al. | |
| 4,629,849 | A | 12/1986 | Mizutani et al. | |
| 5,434,391 | A * | 7/1995 | Eke | 219/681 |
| 6,452,142 | B1 * | 9/2002 | Eke | 219/746 |

FOREIGN PATENT DOCUMENTS

| | | | |
|---|---|---|---|
| GB | 2028069 | A | 2/1980 |
| GB | 2039200 | A | 7/1980 |
| WO | WO-01/58216 | A | 8/2001 |

* cited by examiner

*Primary Examiner*—Philip H. Leung
(74) *Attorney, Agent, or Firm*—Barnes & Thornburg LLP

(57) ABSTRACT

A microwave oven comprises a magnetron for delivering microwave power to a cavity of the oven, a rotatable phase modular (19) an electrical resistance heating element (12) and a rotatable fan (20) for forcing air over the resistance heating element (12) and though the cavity. The phase modulator (19) and the fan (20) are mounted on a common driveshaft (18). A matchplate (9) is mounted in the cavity.

19 Claims, 2 Drawing Sheets

MICROWAVE OVEN WITH PHASE MODULATOR AND FAN ON COMMON DRIVESHAFT

FIELD OF THE INVENTION

This invention relates to microwave ovens, and in particular to such ovens having magnetrons for delivering microwave power to the oven cavities and forced hot air systems for recirculating hot air through the cavities.

SUMMARY OF THE INVENTION

According to the invention a microwave oven comprises a magnetron for delivering microwave power to a cavity of the oven, a rotatable phase modulator for preventing the establishment of dominant standing waves in the cavity, and a forced hot air system comprising electrical resistance heating means and a rotatable fan for forcing air over the resistance heating means and through the cavity, wherein the phase modulator and the fan are mounted on a common driveshaft.

The driveshaft preferably extends through a launch box by means of which microwave power is delivered from the magnetron to the cavity, and in a preferred embodiment the common drive shaft is rotatably driven by an electric motor attached to an external surface of an outer wall of the launch box. The rotational speed of the driveshaft is preferably between 1500 and 2500 rpm, most preferably about 2000 rpm.

The phase modulator may have blades extending from one or both sides of a disc-like plate disposed in a plane perpendicular to the rotational axis of the shaft, and in a preferred embodiment the disc-like plate is spaced from the internal surface of the rear wall of the launch box by a distance corresponding to a quarter wavelength at the operating frequency of the magnetron.

The fan may also have blades extending from one or both sides of a disc-like plate disposed in a plane perpendicular to the rotational axis of the shaft, and in the preferred embodiment the respective planes of the disc-like plates of the modulator and the fan are spaced by a distance corresponding to a quarter wavelength, the fan being further away from the outer wall of the launch box am the phase modulator. The spatial distance corresponding to a quarter wavelength is not invariable at a given operating frequency, because the length of a complete wave will depend on the surrounding structure. Thus, the spacing in millimetres between the disc-like plate of the phase modulator and the internal surface of the rear wall of the launch box is not necessarily identical to the spacing in millimeters between the plates of the phase modulator and the fan. Indeed, in the preferred embodiment these dimensions are respectively 36 mm and 44 mm at the magnetron operating frequency of 2455 plus or minus 20 Mhz.

It was found by experiment that the position of the phase modulator and the position of the fan were crucial to the achievement of even microwave power distribution within the cavity.

The electrical resistance beating means conveniently comprises an electrical resistance heating element disposed radially outwardly of the fan, and may also include farther electrical resistance heating elements in the cavity.

In the embodiment to be described, a metal plate is fixed in the cavity and serves not only as a match plate for transferring microwave power from the launch box to the cavity but also serves as a baffle plate for the forced hot air convection system, in the manner disclosed in the inventor's U.S. Pat. No. 5,434,391.

The metal plate may be supported in the cavity so that a front surface of the plate faces into the cavity and a rear surface of the plate faces a launch area, there being a spacing between the peripheral edge of the plate and the walls of the cavity, the spacing being defined partly by an air gap and partly by blanking material which allows the passage of microwave power but blocks or impedes the passage of forced hot air. Preferably, microwave power reaches the cavity around the complete periphery of the plate but forced hot air reaches the cavity through said air gap but not through the blanking material. The blanking material has low thermal conductivity but allows the transmission of microwave energy, a suitable material being glass or mica. Preferably, the metal plate is apertured by virtue of having a series of holes therein and the fan is operative to draw air from the cavity through the holes and thence to direct the hot air through the air gap so as to re-circulate the air to the cavity.

The metal plate is preferably rectangular, with a first pair of opposed sides of the peripheral edge being spaced by the air gap and the other pair of opposed sides of the peripheral edge adjoining strips of the blanking material.

Preferably the first pair of opposed sides are formed by upper and lower side edges of the metal plate, meaning that all or substantially all the hot air reaches the cavity by passing the upper and lower edges of the metal plate, and in this case the cavity advantageously has upper and lower electrical resistance heating elements constituting grill and baking elements respectively.

BRIEF DESCRIPTION OF THE DRAWINGS

A microwave oven according to the invention will now be described, by way of example, with reference to the accompanying drawings, in which.

DETAILED DESCRIPTION OF THE DRAWINGS

Figure 1:
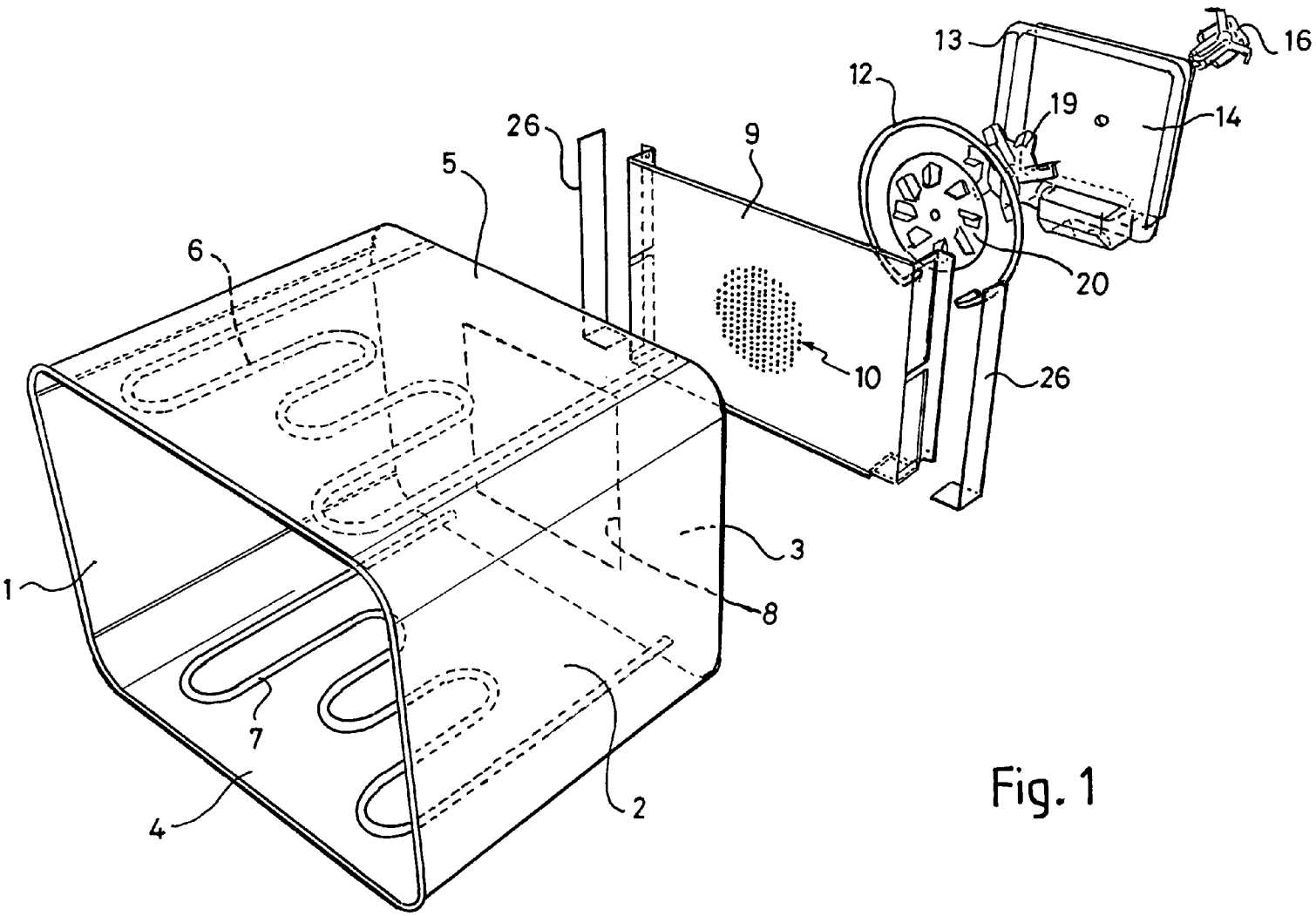
FIG. 1 is an isometric view of the oven with parts in exploded view.

The oven has a cavity defined by two side walls 1 and 2, a rear wall 3, a base wall 4 and a top wall 5. The front of the cavity is closable by a hinged door (not shown).

Within the cavity and adjacent to the top wall 5 is a top electrical resistance heating element 6, of sinuous shape, serving as a grill element. A bottom electrical resistance heating element 7 of similar shape, spaced a short distance above the base wall 4, serves as a baking element.

The rear wall 3 has a rectangular aperture 8 therein. A vertical metal plate 9 is mounted in the cavity a short distance in front of the rear wall 3, the plate 9 overlapping the aperture 8. A central circular area of the plate 9 has a series of holes 10 therein. The metal matchplate 9 has dimensions chosen to create edge coupling to all the resonant modes that exist within the oven cavity over the frequency range of 2455±20 Mhz. An arcuate electrical resistance heating element 12 is positioned behind the plate 9 and lies outwardly of the aperture 8.

To the outside of the rear wall 3 and covering the aperture 8 is attached a launch box 13 having a rear wall 14 parallel with the rear wall 3 of the cavity and side walls terminating in out-turned flanges by which the launch box 13 is secured (e.g. by bolts or welding) to the rear wall 3. A wave guide 15 is attached to the lower side of the launch box 13 and directs microwave energy from a magnetron (not shown) into the launch box 13. An electric motor 16 and choke assembly 17 are attached to the external side of the rear wall 14 of the launch box 13, a drive shaft 18 of the electric motor extending horizontally through the launch box and also through the aperture 8. The shaft 18 carries, within the launch box, a rotatable phase modulator 19 and the extremity of the shaft carries a rotatable fan 20 which is positioned radially inwardly of the element 12. The phase modulator 19 prevents the establishment of dominant standing waves in the cavity.

The phase modulator 19 has a central disc-like plate 22 with blades extending on both sides therefrom and the plate 22 is accurately positioned to be a distance of 36 mm from the launch box rear wall 14, which corresponds to a quarter wavelength in that situation. The fan 20 has a disc-like plate 24 with blades extending forwardly thereof and the plate 24 is accurately positioned to be a distance of 44 mm from the plane of the plate 22, this distance of 44 mm corresponding to the quarter wavelength in the situation illustrated. It will be seen from FIG. 2 that the wall 14, the plates 22 and 24, the wall 3 and the plate 9 occupy parallel vertical planes.

As a consequence of the plate 9 being spaced a short distance in front of the rear wall 3, the four edges of the plate 9 are separated from the walls of the cavity, and along the two side edges of the plate 9 this separation is spanned by strips 26 of mica or like material which allows the propagation of microwave energy but impedes the passage of air flow. Along the upper and lower edges of the plate 9, the spacing between the plate 9 and the cavity wall 5 forms open slots 23 through which hot air reaches the cavity.

Figure 2:
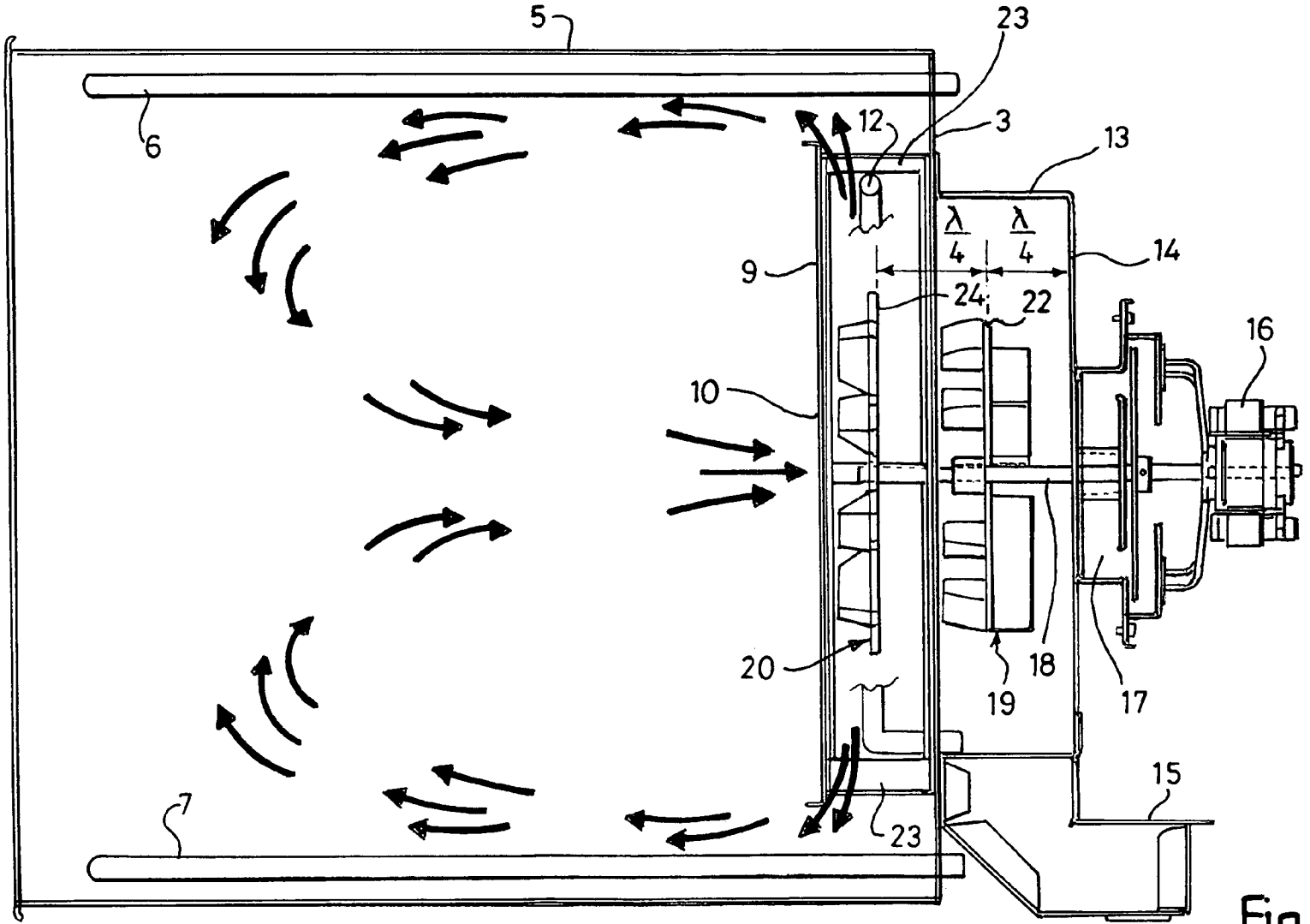
FIG. 2 is a sectional view of the oven on a central vertical plane.

In use, the magnetron delivers microwave power to the cavity, via the wave guide 15, the launch area defined by the launch box 13 and around all four edges of the plate 9. Simultaneously, the electric motor 16 drives the shaft 18 (typically at 2000 rpm) and rotates the phase modulator 19 and convection fan 20 at this rotational speed. Air, driven by the fan 20, passes over the convection element 12 where it is heated and then passes into the cavity through the two slots 23 along the upper and lower edges of the plate 9. This air passes across the upper and lower heating elements 6 and 7 before being drawn through the central holes 10 in the plate 9 which thus serves not only as a baffle plate for the convection air but also as a match plate for the microwave system. The arrows in FIG. 2 show the air circulation within the cavity.

The components shown in the drawings comprise a modularised system in that the components can be fitted to the back wall of any size of oven cavity, providing that the plate 9 is sized effectively to couple microwave power to the propagating modes that exist within the oven cavity. In the example described and illustrated in the drawings, the cavity has a depth of 406 mm, a height of 350 mm and a width of 472 mm. The use of a single motor 16 to drive the phase modulator 19 and the fan 20 has advantages of simplicity and effectiveness, providing that the phase modulator 19 and fan 20 are accurately positioned in the manner described.

The invention claimed is:

1. A microwave oven comprising a magnetron for delivering microwave power to a cavity of the oven, a rotatable phase modulator for preventing the establishment of dominant standing waves in the cavity, and a forced hot air system comprising an electrical resistance heater and a rotatable fan for forcing air over the heater and through the cavity, wherein the phase modulator and the fan are mounted on a common driveshaft which extends through a launch box by means of which microwave power is delivered from the magnetron to the cavity, wherein the phase modular has blades extending from one or both sides of a disc-like plate disposed in a plane perpendicular to the rotational axis of the shaft, and wherein the disc-like plate is spaced from the internal surface of the outer wall of the launch box by a distance corresponding to a quarter wavelength at the operating frequency of the magnetron and wherein the fan also has blades extending from one or both sides of a disc-like plate disposed in a plane perpendicular to the rotational axis of the shaft, and wherein the respective planes of the disc-like plates of the modulator and the fan are spaced by distance corresponding to a quarter wavelength, the fan being further away from an outer wall of the launch box than the phase modulator.

2. A microwave oven according to claim 1, wherein the common driveshaft is rotatably driven by an electric motor attached to an external surface of the outer wall of the launch box.

3. A microwave oven according to claim 1, wherein the rotational speed of the driveshaft is between 1500 and 2500 rpm.

4. A microwave oven according to claim 1, wherein the electrical resistance heater comprises an electrical resistance heating element disposed radially outwardly of the fan.

5. A microwave oven according to claim 1, wherein a metal plate is fixed in the cavity and serves not only as a match plate for transferring microwave power to the cavity but also serves as a baffle plate for the forced hot air convection system.

6. A microwave oven according to claim 5, wherein the metal plate is supported in the cavity so that a front surface of the metal plate faces into the cavity and a rear surface of the metal plate faces a launch area, there being a spacing between the peripheral edge of the metal plate and the walls of the cavity, the spacing being defined partly by an air gap and partly by blanking material which allows the passage of microwave power but blocks or impedes the passage of forced hot air.

7. A microwave oven according to claim 6, wherein microwave power reaches the cavity around the complete periphery of the metal plate but forced hot air reaches the cavity through said air gap but not through the blanking material.

8. A microwave oven according to claim 6, wherein the blanking material is glass or mica.

9. A microwave oven according to claim 6, wherein the metal plate is apertured by virtue of having a series of holes therein and the fan is operative to draw air from the cavity through the holes and thence to direct the hot air through the air gap so as to re-circulate the air to the cavity.

10. A microwave oven according to claim 6, wherein the metal plate is rectangular, with a first pair of opposed sides of the peripheral edge being spaced by the air gap and the other pair of opposed sides of the peripheral edge adjoining strips of the blanking material.

11. A microwave oven according to claim 10, wherein the first pair of opposed sides are formed by upper and lower sides edges of the metal plate, meaning that all or substantially all the hot air reaches the cavity by passing the upper and lower edges of the metal plate.

12. A microwave oven according to claim 11, wherein the cavity has upper and lower electrical resistance heating elements constituting grill and baking elements respectively.

13. A microwave oven comprising a magnetron for delivering microwave power to a cavity of the oven, a rotatable phase modulator for preventing the establishment of dominant standing waves in the cavity, and a forced hot air system comprising an electrical resistance heater and a rotatable fan for forcing air over the heater and through the cavity, wherein the phase modulator and the fan are mounted on a common driveshaft, wherein a metal plate is fixed in the cavity and serves not only as a match plate for transferring microwave power to the cavity but also serves as a baffle plate for the forced hot air convection system, and wherein the metal plate is supported in the cavity so that a front surface of the metal plate faces into the cavity and a rear surface of the metal plate faces a launch area, there being a spacing between the peripheral edge of the metal plate and the walls of the cavity, the spacing being defined partly by an air gap and partly by blanking material which allows the passage of microwave power but blocks or impedes the passage of forced hot air.

14. A microwave oven according to claim 13, wherein microwave power reaches the cavity around the complete periphery of the metal plate but forced hot air reaches the cavity through said air gap but not through the blanking material.

15. A microwave oven according to claim 13, wherein the blanking material is glass or mica.

16. A microwave oven according to claim 13, wherein the metal plate is apertured by virtue of having a series of holes therein and the fan is operative to draw air from the cavity through the holes and thence to direct the hot air through the air gap so as to re-circulate the air to the cavity.

17. A microwave oven according to claim 13, wherein the metal plate is rectangular, with a first pair of opposed sides of the peripheral edge being spaced by the air gap and the other pair of opposed sides of the peripheral edge adjoining strips of the blanking material.

18. A microwave oven according to claim 17, wherein the first pair of opposed sides are formed by upper and lower sides edges of the metal plate, meaning that all or substantially all the hot air reaches the cavity by passing the upper and lower edges of the metal plate.

19. A microwave oven according to claim 18, wherein the cavity has upper and lower electrical resistance heating elements constituting grill and baking elements respectively.

* * * * *